United States Patent [19]

Wehle

[11] Patent Number: 4,693,006

[45] Date of Patent: Sep. 15, 1987

[54] CHAIN SAW HAVING A HANDLE

[75] Inventor: Anton Wehle, Fellbach, Fed. Rep. of Germany

[73] Assignee: Andreas Stihl, Waiblingen, Fed. Rep. of Germany

[21] Appl. No.: 877,212

[22] Filed: Jun. 20, 1986

[30] Foreign Application Priority Data

Jun. 28, 1985 [DE] Fed. Rep. of Germany ..... 3523146

[51] Int. Cl.[4] ..... B27B 17/02

[52] U.S. Cl. ..... 30/383; 173/162 H

[58] Field of Search ..... 30/383, 382, 384; 173/162 R, 162 H; 74/543

[56] References Cited

U.S. PATENT DOCUMENTS

| | | | |
|---|---|---|---|
| 2,610,657 | 9/1952 | Kiekhaefer | 30/383 |
| 3,006,388 | 10/1961 | Root | 30/383 |
| 3,131,277 | 4/1964 | Brenzen | 30/382 |
| 3,368,595 | 2/1968 | Gutjahr | 30/382 |
| 3,380,493 | 4/1968 | Giroux | 30/382 |
| 3,728,793 | 4/1973 | Makinson | 30/383 |

*Primary Examiner*—E. R. Kazenske
*Assistant Examiner*—Michael D. Folkerts
*Attorney, Agent, or Firm*—Walter Ottesen

[57] ABSTRACT

The motor-driven chain saw has a first handle at the back end for holding and operating the tool and a second handle mounted farther toward the front of the tool housing. The second handle is mounted so as to be spaced from and to surround the housing and is used for holding and guiding the tool. One end of the second handle is secured to the underside of the housing, and its other end is secured to the longitudinal housing side on which the guide bar for accommodating the moving saw chain is also mounted. The second handle is bent backward from the transverse plane on this side of the housing, approximately at the elevation of the guide bar, where it is secured to this longitudinal side of the housing nearer the back thereof. A strut extends downwardly and rearwardly from the top of the second handle and its free end is secured to the housing together with the end of the rearwardly-extending portion of the second handle.

10 Claims, 5 Drawing Figures

CHAIN SAW HAVING A HANDLE

FIELD OF THE INVENTION

The invention relates to a motor-driven chain saw having a housing, a drive unit and a guide bar for guiding the saw chain thereon. A first handle is mounted on the rear wall of the housing for holding and operating the chain saw. A second handle is provided for holding and guiding the chain saw.

BACKGROUND OF THE INVENTION

Motor-driven chain saws of this kind typically have two handles, namely, a holding and operating handle provided on the back end of the housing and a holding and guiding handle located farther forward. While the holding and operating handle on the back of the housing is approximately coaxial with the guide bar, the front holding and guiding handle is disposed in a transverse plane, usually a centroidal plane, between the guide bar and the holding and operating handle. With this arrangement of the handles, the tool can be held and guided securely by the operator with both hands while the tool is in operation.

In a known tool of this kind, the motor-driven chain saw Type 034 manufactured by Andreas Stihl, the holding and guiding handle surrounds the machine housing on both longitudinal sides and on the top in a spaced apart manner; both ends of the handle are secured to the underside of the housing and are joined by a damping or shock absorbing member. To increase stability, a strut is provided on the top of the holding and guiding handle. This strut extends rearwardly and downwardly and along one longitudinal side of the housing, and is secured there at its end. The holding and guiding handle, which is freely accessible at three sides, that is, the two longitudinal sides and the top, is intended to permit the tool to be guided securely even in emergencies.

A disadvantage of the known handle arrangement is that the protective cover on the longitudinal side of the housing near the guide bar, which covers the portion of the guide bar, saw chain and drive pinion near the housing, must be extended downwardly to near the bottom of the tool for safety reasons; otherwise, the operator's hand, gripping the holding and guiding handle in this area, could be injured by the moving saw chain. Extending the cover so far downwardly, however, makes it considerably more difficult to eject chips, and under adverse conditions the chip ejection channel may become plugged, which causes undesirable, time-consuming interruptions in the work.

A further disadvantage of the known handle arrangement is that because the holding and guiding handle is extended around the tool, both ends of the handle are secured to the underside of the machine in overlapping fashion, separated by a damping member, because as a result either the tool housing must be extended very far downward, or else there will be a sill or ledge on the bottom of the tool, which hinders sliding the machine on its bottom. The handle is secured such that it protrudes beyond the base wall so that the securing location must also be disposed as close as possible to the front to prevent the tool from tipping forward if it is set down on the ground. Securing the holding and guiding handle in this way does not correspond to an arrangement of the handle in a centroidal plane of the tool, an arrangement which is highly advantageous for tool operation.

SUMMARY OF THE INVENTION

Accordingly, it is an object of the invention to provide a motor-driven chain saw which can be held and guided securely even in a constrained position, such as when cutting horizontally, yet in which plugging up of the machine by ejected chips and the like is effectively prevented.

To attain this object, a holding and guiding handle is provided for the chain saw that is bent backward from the transverse plane, approximately at the level of the guide bar, on the longitudinal side of the housing near the guide bar, and is extended rearwardly spaced apart from this side and there secured to the housing.

Because the holding and guiding handle is advantageously embodied and mounted in this manner, the bottom of the cover that protects the saw chain near the housing can be shortened so that chips can be ejected in this area without hindrance and without presenting the risk of plugging the tool. Arranging the handle according to the invention also increases the operational reliability of the tool, because it can be much better guided when in a constrained position, especially when the tool is rotated by 90°; if the rearwardly-directed part of the handle is at the top (as in horizontal sawing), the machine can be securely guided and moved toward the work, because the operator's hand will gain a secure hold in the bend of the handle virtually without a grasping effort.

In terms of the transmission of resonant vibrations of the motor of the tool, this handle arrangement again offers considerable advantages: first, the damping member that is provided between the ends of the handle in the known tool can be dispensed with; second, the asymmetrical arrangement of the holding and guiding handle makes it particularly secure against resonant vibration. In a particularly favorable embodiment of the handle which can be attached to the tool at only two points, an additional strut is extended obliquely rearwardly and downwardly from the top of the holding and guiding handle and is secured to one longitudinal side of the housing together with the rearward-bent end of the handle. As a result, with the same number of securing points, the stability of the handle is increased, and the torsional strain is lessened, especially in the lower parts of the handle. By securing one end of the holding and guiding handle at the point where the strut is secured to the housing, the natural angular frequency of the holding and guiding handle is shifted toward higher frequencies, which makes the handle part particularly vibration-free in terms of the structure-borne vibrations. In a further feature of the invention, the handle becomes readily accessible in its rearwardly-directed part as well, almost to the securing point.

In order to provide the handle with a tubular cushioning covering, as is usually done with handles of this kind, a further embodiment of the invention has an intermediate member between the end of the holding and guiding handle that is directed rearwardly and the point at which the latter is secured on the adjacent longitudinal side of the housing; this intermediate member is preferably attached by a screw connection only after the tubular covering has been slipped over the handle. It is particularly favorable for the intermediate member, continuing the cross section of the handle, to be tubular, and for a slot to be provided on the outside of the intermediate member to provide accessibility to the attaching locations.

BRIEF DESCRIPTION OF THE DRAWING

The invention will now be described with reference to the drawing wherein.

DESCRIPTION OF THE PREFERRED EMBODIMENT OF THE INVENTION

Figure 1:
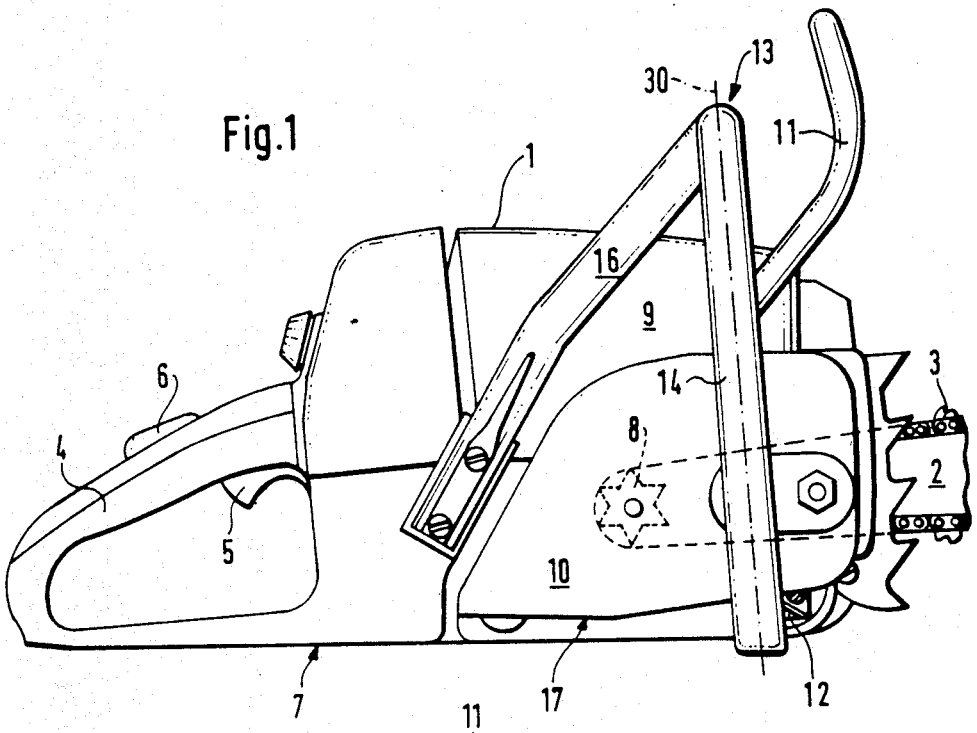
FIG. 1 is a side elevation view of a motor-driven chain saw according to the prior art.
Figure 2:
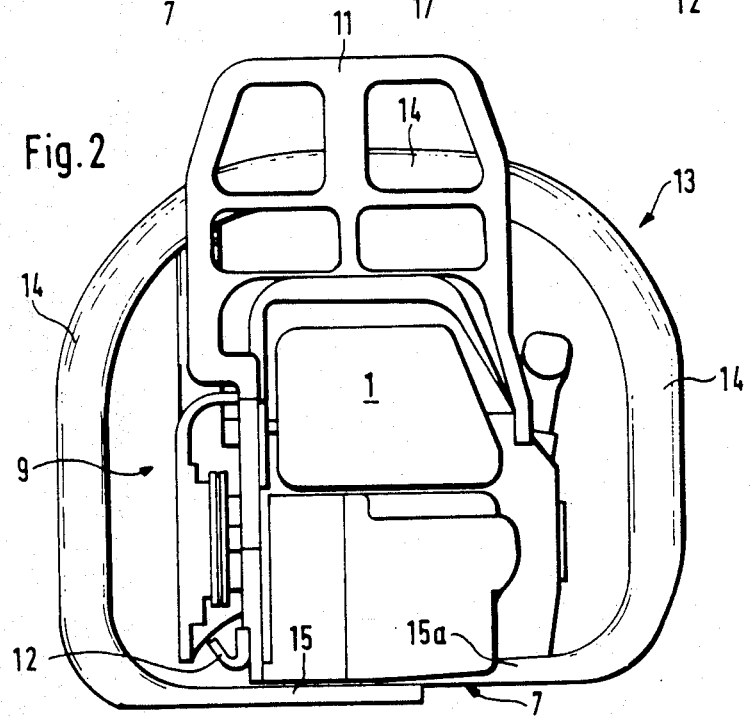
FIG. 2 is a front elevation view of the motor-driven chain saw of FIG. 1.
Figure 3:
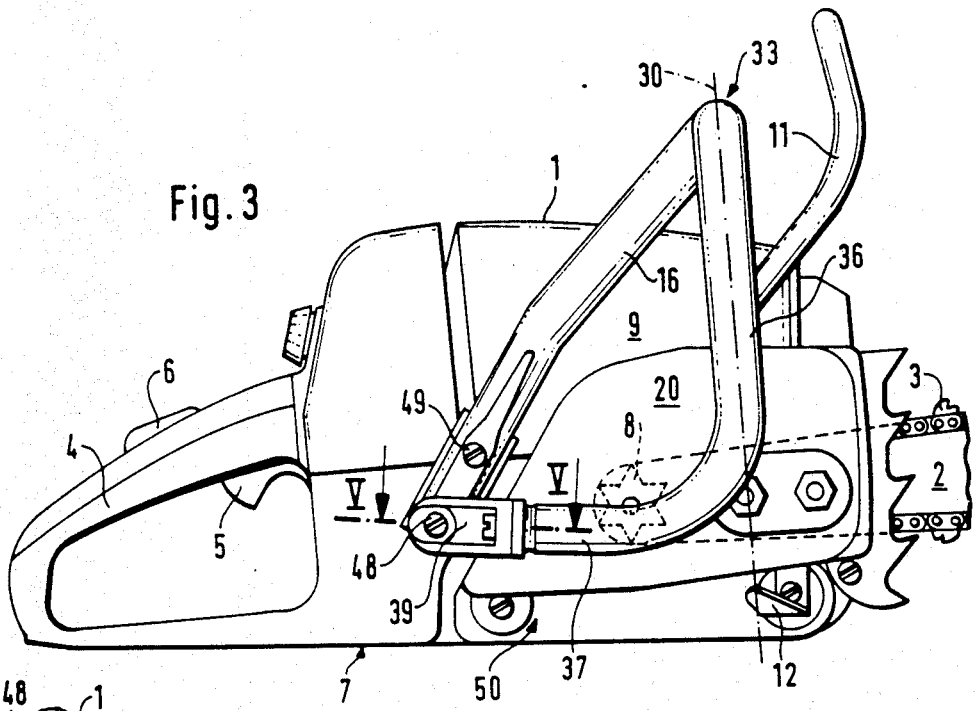
FIG. 3 is a side elevation view of the motor-driven chain saw according to the invention.

FIGS. 1 and 2 show a motor-driven chain saw according to the prior art, having a housing 1, from the front of which a guide bar 2 projects for accommodating a saw chain 3 for movement thereon. The guide bars 2 depicted in FIGS. 1 and 3 are only partially shown. On the back end, the housing is provided with a holding and operating handle 4, which in a known manner has a gas trigger 5 or gas trigger switch, which can be actuated after pressing in the gas trigger lock 6 disposed on top of the handle 4. In the unit shown here, the rearward holding and operating handle is molded onto the housing 1 and is joined to the underside 7 of the housing 1. A drive unit, not shown, is accommodated in the housing 1 and a driving sprocket wheel 8 which drives the saw chain 3 is mounted on its drive shaft. The housing 1 shown here is intended for a drive unit equipped with an internal combustion engine; however, an electric motor is also possible.

As shown in FIG. 2, the guide bar 2 with saw chain 3 is mounted near the righthand longitudinal side 9 of the tool, as viewed from back to front. In the vicinity of the tool housing 1, the saw chain 3 is covered on the outside by a protective cover 10, which extends almost to the underside 7 of the housing 1. Between the underside of the cover 10 and the underside 7 of the housing 1, in the front portion of the machine, is a safety catch 12 for stopping the saw chain 3 if it breaks. Near the front and top of the housing 1, there is a hand guard 11, which may for instance be configured as a trigger lever for a chain brake.

Figure 5:
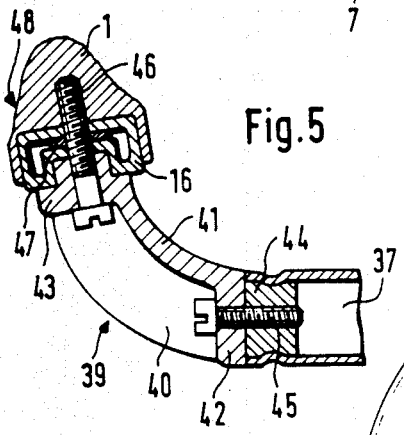
FIG. 5, on a larger scale, is a section view taken along the line V—V of FIG. 3; in this view, only the intermediate member and the corresponding securing points on the housing and handle are shown.
Figure 4:
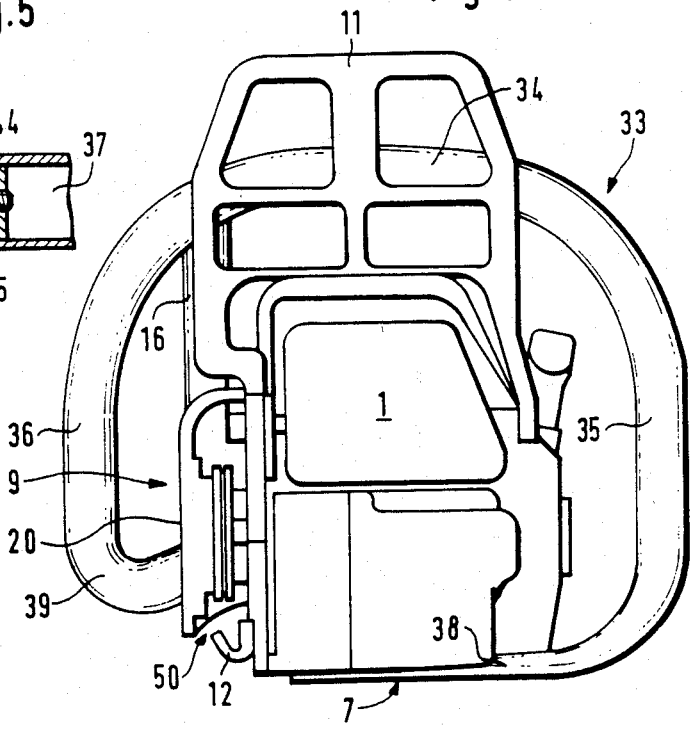
FIG. 4 is a front elevation view of the motor-driven chain saw of FIG. 3.

The motor-driven chain saw shown in FIGS. 1 and 2, as found in the prior art, differs from the motor-driven chain saw according to the invention as shown in FIGS. 3 to 5 with respect to the configuration and disposition of the holding and guiding handle 33 and with respect to the configuration of the protective cover 20. As shown in FIGS. 1 and 2, the holding and guiding handle 13 of the motor-driven chain saw of the prior art is located in a transverse plane 30 between the guide bar 2 and the holding and operating handle 4. The handle 13 comprises the actual handle part 14, which surrounds and is spaced from the housing 1 on both longitudinal sides and on the top, and the securing parts 15 and 15*a* which rest on the underside of the housing 1 and are attached to the latter at this location. As FIG. 1 shows, the securing parts 15 and 15*a* are configured as flat, overlapping ends; between the overlapping ends, a damping member (not shown) is mounted for providing insulation from vibration. The damping member is secured to the tool bottom together with the parts 15 and 15*a*. Consequently, there is a ridge 15 protruding downwardly from the housing bottom as shown in FIG. 2.

For stability and because of vibration, a strut 16 is provided, which is welded to the top of the handle part 14 approximately above the guide bar 2, on the handle 13 and extends obliquely downwardly and backwardly along the longitudinal side 9 of the housing. The strut 16 is secured to the housing approximately at the level of the guide bar 2. Since the handle part 14 extends as far as the underside of the machine on the longitudinal housing side 9 near the guide bar 2, the protective cover 10 is extended almost to the bottom of the housing 1, for safety reasons, so as to prevent injury to the hand of the operator gripping the handle part 14. Because the protective cover 10 is extended so far downward, the chip ejection channel 17 defined by it is relatively narrow.

The motor-driven chain saw according to the invention and shown in FIGS. 3 to 5 is embodied like the above-described motor-driven chain saw of the prior are (FIGS. 1 and 2), except for the disposition and configuration of the holding and guiding handle 33 and protective cover 20. The holding and guiding handle 33 extends in a transverse plane 30 between the guide bar 2 and the rear holding and operating handle 4 and in a longitudinal plane between the guide bar 2 and the rear handle 4, approximately parallel to the bottom 7 of the tool. The handle 33 comprises the actual handle portions 34 to 37, the attaching portion 38 and the intermediate member 39 that is used to secure the handle.

The handle portions 34 to 37 are disposed spaced from the housing 1 and are arranged to be gripped with the hand by the operator. The upper handle portion 34 that extends approximately parallel to the tool bottom 7 and the two downwardly-directed handle portions 35 and 36 are located in the transverse plane 30 between the guide bar 2 and the rear handle 4; the handle portion 35 is bent on its underside to form a securing portion 38, also located in this transverse plane, which is placed in a groove in the tool bottom 7 and secured there. The securing portion 38 is flush with the tool bottom 7.

The lateral, downwardly-directed handle portion 36 located near the guide bar 2, parallel to the longitudinal housing side 9, is bent backward out of the transverse plane approximately at the elevation of the guide bar 2 (FIG. 3) and continues into the rearwardly-directed handle portion 37. This rearwardly-directed handle portion 37 extends rearwardly spaced from the longitudinal housing side 9 and approximately parallel to the tool bottom 7. At the end of the rearwardly-directed handle portion 37 is an intermediate member 39 that is bent toward the longitudinal housing side 9 and attached thereto. A strut 16 is secured to the upper handle portion 34, approximately above the guide bar 2, and extends substantially rearwardly and downwardly along the longitudinal housing side 9, where it is attached to the housing 1 together with the intermediate member 39.

In this embodiment, the holding and guiding handle 33 is made of lightweight metal tubing, with the tubular portions 34 to 38 configured as one piece and shaped appropriately by bending; the radii of the bends are selected to be large enough that the handle 33 can still be held securely with one hand in the vicinity of the bend; the strut 16 is welded to the upper handle portion 34. The above-described embodiment using lightweight metal tubing is preferred, because of its light weight primarily, but other profiles, or solid material, can also be used. It is also possible to make the handle out of other metals, plastic, or the like.

In the embodiment shown in FIGS. 3 to 5, the handle portions 34 to 37 are wrapped in plastic in a known manner (not shown). If the plastic wrapping of the handle portions 34 to 37 is accomplished as here, by pulling on a plastic tube, then the ends of the tube must be freely accessible, so that the plastic tube can be slipped thereover. For this purpose, the intermediate member 39 of the holding and guiding handle 33 is configured as an intermediate member 39 and adapted for being mounted with the aid of threaded fasteners and which is mounted only after the plastic tube has been pulled on. If a sewn padded handle, or a sprayed-on foam padded handle or the like, is used, then the intermediate member 39 may also be integrally embodied with the handle portions 34 to 37. The intermediate member 39 used here has approximately the same cross section as the other handle portions 34 to 37 and is secured with threaded fasteners as shown in FIGS. 3 and 5.

The intermediate member 39, which may for example be a cast part, is made of a tube 41 in this embodiment, bent about an angle of not quite 90° as shown in FIG. 5, and provided on its ends with end walls 42 and 43. The end walls 42 and 43 may be provided by inserting tightly fitting cylindrical plugs, by welding on end plates, or the like. On its outer bend, the intermediate member 39 has a slot-like recess 40, which is provided for securing the screws 45 and 46 (FIG. 5). In this embodiment, the intermediate member 39 is secured with screws; corresponding bores are provided in the end walls 42 and 43, in which screws 45 and 46 are located, which join the intermediate member 39 to the rearwardly-directed handle portion 37 and to the housing 1, respectively. To effect screw fastening of the intermediate member 39 to the handle 33, a threaded insert 44 is provided on the end of the handle portion 37; in this embodiment, the insert 44 is retained by a press fit.

Toward the tool, the free end of the strut 16 is located between the end wall 43 of the intermediate member 39 and the housing 1; at a securing point 48, the strut 16 is tightly screwed to the housing 1 together with the intermediate member 39. As shown in a projection in FIG. 3 and in section in FIG. 5, the end of the strut 16 is U-shaped toward the attachment point 48, so that the head of the second attaching screw 49 is located inside this U-shaped portion. Depending on the configuration of the U-shaped portion, a support body 47 (FIG. 5) may be provided inside the tube. The securing portion 38 of the handle 33 may be embodied similarly to the free end of the strut 16, so that when the parts are secured with screws, the heads of the screws will also be flush with the housing bottom 7.

As FIG. 3 shows, the protective cover 20 is not extended as far downwardly as the protective cover 10 shown in FIG. 1, so that in this case a chip ejection channel 50 of considerably larger cross section is formed. The protective cover 20 is extended a safe distance away, to below the rearwardly-directed handle portion 37, so that an injury to the hand of the operator in the vicinity of the handle portion 37 is prevented. Because of the larger chip ejection channel 50, the chips carried along with the saw chain 3 can travel freely to the back and emerge at the bottom, without any danger that the channel 50 will become plugged.

The tool according to the invention is particularly safe and simple to manipulate. During operation, the motor-driven chain saw is held with one hand on the holding and operating handle 4, and the gas trigger lock 6 is released by gripping the handle 4 so that the gas trigger 5 can be operated with a finger. The other hand grips the holding and guiding handle 33, which is advantageously located in a centroidal plane 30 of the machine. Because of the stable and low-vibration configuration of the handle 33, the tool can be securely held in this region even in constrained positions, because the handle 33 is freely accessible all around the housing 1. The rearwardly-directed handle portion 37 provides a particularly secure support if the tool is held rotated by 90° about its longitudinal axis so that the handle portions 36 and 37 are facing upwardly. In this position, the hand is effectively prevented from slipping from the handle 36 toward the housing bottom 7 by the bent portion 37. The hand assumes a particularly secure position in the bend between the portions 36 and 37, and in this position the risk of injury from slipping off is virtually precluded, and all the strength of the hand or arm can be transmitted to the tool. In this short, particularly rigid portion of the handle 33 (handle portions 36, 37 and 39), the handle is particularly of low resonance, so that the vibration load on the operator is especially low in the constrained position of the tool. The securing screws 49, 46 and 45 are embedded completely in the corresponding handle and strut parts, so that the risk of injury from protruding screw heads is completely avoided.

The securing portion 38 of the holding and guiding handle 33 is flush with the underside 7 of the housing 1, so that the tool can easily be slid along a surface. The tool is also prevented from tipping forward about the securing portion 38 by its flush fit with the tool bottom; in this case, the tilting axis is the line of intersection between the front and the underside 7 of the tool so that even with long guide bars 2, the tool is reliably prevented from tilting forward.

It is understood that the foregoing description is that of the preferred embodiments of the invention and that various changes and modifications may be made thereto without departing from the spirit and scope of the invention as defined in the appended claims.

What is claimed is:

1. A motor-driven chain saw comprising:

a housing having a front wall, a rear wall, two longitudinal side walls extending rearwardly from said front wall to said rear wall, a base wall extending between said side walls, and a top wall extending between said side walls above said base wall;

an elongated guide bar for accommodating a saw chain for movement thereon, said guide bar defining a longitudinal axis along its length and being mounted on one of said side walls and extending outwardly past said front wall;

a drive unit mounted in said housing for moving said saw chain around said guide bar;

a protective cover mounted on said one side wall for covering said saw chain at the housing end thereof;

a first handle on said rear wall of said housing for holding and operating the chain saw;

a second handle for holding and guiding the chain saw, said second handle being substantially disposed in a plane transverse to said guide bar at a location between the latter and said first handle, said second handle being spaced from said top wall and said side walls;

said second handle having a first portion spaced from the other one of said sides and extending past said other side so as to be attached to said base wall; said second handle further having a second portion bent out of said plane so as to be directed and extend rearwardly therefrom substantially parallel to and at an elevation corresponding approximately to that of said longitudinal axis of said guide bar, said second portion having a rearward end portion and being spaced away from said one side wall and said protective cover up to the rearward end portion thereof so as to permit an operator of the chain saw to safely grasp said second handle at said second portion; and, said end portion being attached to said housing thereby securing said second handle to said housing.

2. The motor-driven chain saw of claim 1, said end portion being bent in toward said one side wall, the chain saw comprising attaching means for attaching said end portion to said one side wall at a preselected location thereon.

3. The motor-driven chain saw of claim 1, said protective cover being configured to extend downwardly adjacent said one side wall to an elevation below said second portion of said second handle and at safe spacing therefrom.

4. A motor-driven chain saw comprising:

a housing having a front wall, a rear wall, two longitudinal side walls exending rearwardly from said front wall to said rear wall, a base wall extending between said side walls, and a top wall extending between said side walls above said base wall;

a guide bar for accommodating a saw chain for movement thereon, said guide bar being mounted on one of said side walls and extending outwardly past said front wall;

a drive unit mounted in said housing for moving said saw chain around said guide bar;

a protective cover mounted on said one side wall for covering said saw chain at the housing end thereof;

a first handle on said rear wall of said housing for holding and operating the chain saw;

a second handle for holding and guiding the chain saw, said second handle beig substantially disposed in a plane transverse to said guide bar at a location between the latter and said first handle, said second handle being spaced from said top wall and said side walls;

said second handle having a first portion spaced from the other one of said sides and extending past said other side so as to be attached to said base wall; said second handle further having asecond portion bent out of said plane so as to be directed and extend rearwardly therefrom at an elevation corresponding approximately to that of said guide bar, said second portion having a rearward end portion and being spaced away from said one side wall and said protective cover up to said rearward end portion thereof so as to permit an operator of the chain saw to safely grasp said second handle at said second portion;

said end portion being attached to said housing thereby securing said second handle to said housing;

said second handle having an intermediate portion spaced from said top wall and being between said first portion and said second portion;

a bracing strut attached at one end thereof to said intermediate portion and extending downwardly adjacent said one side wall and at an inclined angle with respect to said second portion; and, attaching means for attaching the lower end of said strut and said end portion to said one side wall at a single preselected location thereon so as to cause the natural angular frequency of said second handle to be shifted toward a higher frequency.

5. The motor-driven chain saw of claim 4, said attaching means comprising an intermediate member extending between said preselected location and said end portion of said second portion for attaching said second portion to said one side wall of said housing.

6. The motor-driven chain saw of claim 5, said attaching means comprising a threaded fastener for attaching said intermediate member to said end portion of said second portion.

7. The motor-driven chain saw of claim 6, said intermediate member having a tubualr cross section and defining a slotted recess for accommodating said threaded fastener therein.

8. The motor-driven chain saw of claim 7, said intermediate member having end walls at respective longitudinal ends thereof and bore means formed in at least the one of said end walls facing said end portion of said second portion for accomodating said threaded fastener therein.

9. A motor-driven chain saw comprising:

a housing having a front wall, a rear wall, two longitudinal side walls extending rearwardly from said front wall to said rear wall, a base wall extending between said side walls, and a top wall extending between said side walls above said base wall;

a guide bar for accommodating a saw chain for movement thereon, said guide bar being mounted on one of said side walls and extending outwardly past said front wall;

a drive unit mounted in said housing for moving said saw chain around said guide bar;

a protective cover mounted on said one side wall for covering said saw chain at the housing end thereof;

a first handle on said rear wall of said housing for holding and operating the chain saw;

a second handle for holding and guiding the chain saw, said second handle being substantially disposed in a plane transverse to said guide bar at a location between the latter and said first handle, said second handle being spaced from said top wall and said side walls;

said second handle having a first portion attached to said base wall and a second portion bent out of said plane so as to be directed rearwardly therefrom at an elevation corresponding approximately to that of said guide bar, said second portion having a rearward end portion and being spaced away from said one side wall until the end portiuon thereof;

said end portion being attached to said housing thereby securing said second handle thereto;

said second handle having an intermediate portion spaced from said top wall and being between said first portion and said second portion;

a bracing strut attached at one end thereof to said intermediate portion and extending downwardly adjacent said one side wall and at an inclined angle with respect to said second portion; and, attaching means for attaching the lower end of said strut and said end portion to said one side wall at a preselected location thereon, said attaching means including: an intermediate member extending between said preselected location and said end portion of said second portion for attaching said second portion to said one side wall of said housing; a threaded fastener for attaching said intermediate member to said end portion of said second portion; said intermediate member having a tubular cross section and defining a slotted recess for accommodating said threaded fastener therein; and, cylindrical bodies press-fitted into respective ends of said intermediate member for defining respective end walls; and, bore means formed in at least the one of said end walls facing said end portion of said second portion for accommodating said threaded fastener therein.

10. The motor-driven chain saw of claim 9, said bore means being also formed in the other one of said end walls; and, said attaching means comprising a further threaded fastener engaging said bore means in said other one of said end walls for attaching both said lower end of said bracing strut and said intermediate member to said one side wall at said preselected location.

* * * * *